United States Patent [19]

Lothmann

[11] 4,189,073

[45] Feb. 19, 1980

[54] SPRING ELEMENT FOR USE IN SLIDING GATE VALVE

[75] Inventor: Joseph Lothmann, Langerwehe, Fed. Rep. of Germany

[73] Assignee: United States Steel Corporation, Pittsburgh, Pa.

[21] Appl. No.: 772,694

[22] Filed: Feb. 28, 1977

Related U.S. Application Data

[63] Continuation of Ser. No. 603,056, Aug. 8, 1975, abandoned.

[51] Int. Cl.[2] ..... B22D 41/02

[52] U.S. Cl. ..... 222/600; 222/512

[58] Field of Search ..... 222/511, 512, 600, 561; 267/65 A, 122

[56] References Cited

U.S. PATENT DOCUMENTS

| | | | |
|---|---|---|---|
| 598,982 | 2/1898 | Egger | 267/65 A |
| 3,664,653 | 5/1972 | Walker | 267/122 X |
| 3,926,406 | 12/1975 | Hind | 251/176 X |

FOREIGN PATENT DOCUMENTS

| | | | |
|---|---|---|---|
| 413732 | 5/1946 | Italy | 267/65 A |
| 297824 | 6/1971 | U.S.S.R. | 267/122 |

*Primary Examiner*—Robert J. Spar
*Assistant Examiner*—Frederick R. Handren
*Attorney, Agent, or Firm*—John F. Carney

[57] ABSTRACT

Spring elements are described that are especially adapted for use in high temperature environments such as for example in sliding gate valves for metal pouring vessels. The spring elements include an expansable chamber defined in part by a bellows member and a thrust surface adapted to apply the spring force. The chamber is filled with a thermally expansive fluid operative to expand the chamber and thus apply the spring force when exposed to elevated temperatures and conversally, to effect retraction of the same when the elevated temperatures are removed.

6 Claims, 3 Drawing Figures

SPRING ELEMENT FOR USE IN SLIDING GATE VALVE

This is a continuation of application Ser. No. 603,056, filed Aug. 8, 1975, now abandoned.

BACKGROUND OF THE INVENTION

The present invention involves spring elements for slide valves, especially those adapted for use on pouring ladles for molten metal, such as steel. A well known type of slide valve comprises a stationary refractory plate, fixed with respect to the ladle and a power operated sliding refractory plate movable with respect to the stationary plate. A pouring bushing may be provided on the downstream side of the sliding plate. Flow passages are provided in the respective plates and the pouring bushing to effect flow of metal from the ladle when the same are disposed in mutual alignment and to terminate flow thereof when the slide plate is moved to dispose the passages out of mutual alignment. Spring elements are provided in such valves to urge the facing surfaces of the respective plates into relatively tight mutual engagement.

Slide valves of this design have a satisfactory operating life. The flow passages in the respective plates which are subjected to the erosive effects of flowing metal and high temperatures are fabricated of mechanically strong and fire resistant material. Moreover, each of the plates can be easily replaced when damaged or when the wear limit is reached. Experience has shown that to ensure safe operation of such valves and to increase the operating life of the respective refractory plates and the pour bushing, it is important that the respective members be tightly pressed against one another by spring elements. The latter provide, on the one hand, the high thrust which is necessary to counteract the hydrostatic pressure acting on the slide plate, especially when the ladle is full and, on the other hand, limits to the excessive pressures that may occur during operation when the facing surfaces of the head and sliding plates are not perfectly even.

To obtain high thrusts and sufficient displacement in a small space, compact spring elements must be used. In conventional apparatus helical compression springs are employed which engage the inside surface of bolt heads, the outside surface of which supports or applies upward pressure to the sliding plate or to the pouring bushing. With this type of spring element the required pressure characteristics can be obtained and, if the displacement of the bolts is limited, the replacement of the sliding plate can readily be performed. Experience has shown, however, that the initially satisfactory characteristics of the compression springs are altered under the influence of heat to which the springs are subjected and after prolonged operation at high temperatures the thrust force exerted on the sliding plate is reduced. Therefore, in order to ensure safe operation, it is necessary to monitor the spring elements and to replace them after relatively brief periods of operation.

The high thermal stresses imposed on the spring elements can be alleviated by proper selection of high temperature resistant spring steels, by additional cooling and by reducing the amount of spring surface in contact with the heated members. While such measures may increase the operating life of the spring elements, their effective operating life is nonetheless unduly limited.

The use of gas operated spring elements in compression spring applications is known. Such spring elements have been described which are conventional pressure containing cylinders connected to storage tanks, for spring action applications. The pressure cylinders and especially their seals are inadequate for use at elevated temperatures. Moreover, the high pressure piping required for their use is bulky, and complicates maintenance inspection and replacement of parts. Also, although the use of storage tanks make it possible to obtain the desired flat spring characteristics, such use complicates installation and, in large measure, impedes cooling.

Moreover, expandable bellows spring elements have been considered for use in slide valve mechanisms for metal pouring vessels. U.S. Pat. No. 3,480,186, issued Nov. 25, 1969 to J. A. Grosko describes spring elements of this type wherein the operating fluid is continually supplied from an external source. While being capable of alleviating some of the problems referred to hereinabove, such spring elements are not totally dispositive of the problem in that the elements must be mounted in a fixed member of the mechanism and thereby lack flexibility of application. The arrangement is further deficient for the reason that each spring element is not mutually independent as manifest by the fact that the development of a leak in one element necessitates shutdown of the valve.

It is to the improvement of spring elements of the described type, therefore, that the present invention is directed.

SUMMARY OF THE INVENTION

According to the present invention there is provided for use in a sliding gate valve for a liquid metal holding vessel having an opening for the through flow of liquid metal including a frame mounted on said vessel adjacent said opening, said frame containing a fixed plate member, a sliding plate member and means for moving said sliding plate member with respect to said fixed plate member, through openings in said plate members adapted to pass liquid metal from said holding vessel when said through openings are substantially axially aligned and spring means for urging said sliding plate member against said fixed plate member wherein the improvement comprises spring means each including an enclosed, substantially cylindrical chamber, a thermally expandable fluid contained in said chamber and an axially displaceable thrust surface at one end of said chamber adapted to engage one of said plate members and to urge the same against the other of said plate members upon expansion of said contained fluid.

Preferably the spring element employs a rigid chamber provided with a sealed and axially movable piston whose piston rod protects beyond the end of the chamber and is provided with a thrust surface. Effective sealing of the pressurized interior of the chamber can be achieved by sealing the piston with respect to its guide bearing through the use of bellows having gas tight and pressure resistant connections to the piston assembly and to the guide bearing. A simple piston assembly guide structure combined with stroke limitation can be obtained by use of a piston rod having a reduced diameter end portion adapted to pass through an opening in the chamber end plate. The shoulder formed by the stepped surface defining the juncture of the reduced diameter portion of the piston rod and the remainder thereof is of a size to engage the chamber end plate and thereby limit the stroke of the piston assembly. The guiding function of such structure can be improved through the use of a fixed guide pin that slidably, telescopically receives the piston rod.

A particularly simple alternate construction of the spring element is obtained when the chamber is formed of axially spaced base and supporting plates, the latter being provided with a thrust surface and wherein the two plates are interconnected by a generally cylindrical bellows. In this arrangement the stroke is limited by means of a flexible metal cable, axially disposed between and having its ends connected to the respective plates.

In each of the described arrangements means are provided to inject a thermally expandable fluid into the respective chambers. Such means are preferably an opening in the end plate through which the fluid can pass to the chamber and a plug for sealing the opening. Experience has shown that the fluid can be a gaseous fluid which remains in the gaseous state at the valve operating temperature or liquids which vaporize at a temperature intermediate room temperature and the valve operating temperature. By preference the operating fluid consists of inert gases such as, for example, nitrogen or argon.

For a better understanding of the invention, its operating advantages and the specific objects obtained by its use, reference should be made to the accompanying drawings and description which relate to preferred embodiments thereof.

DESCRIPTION OF THE PREFERRED EMBODIMENTS

Figure 1:
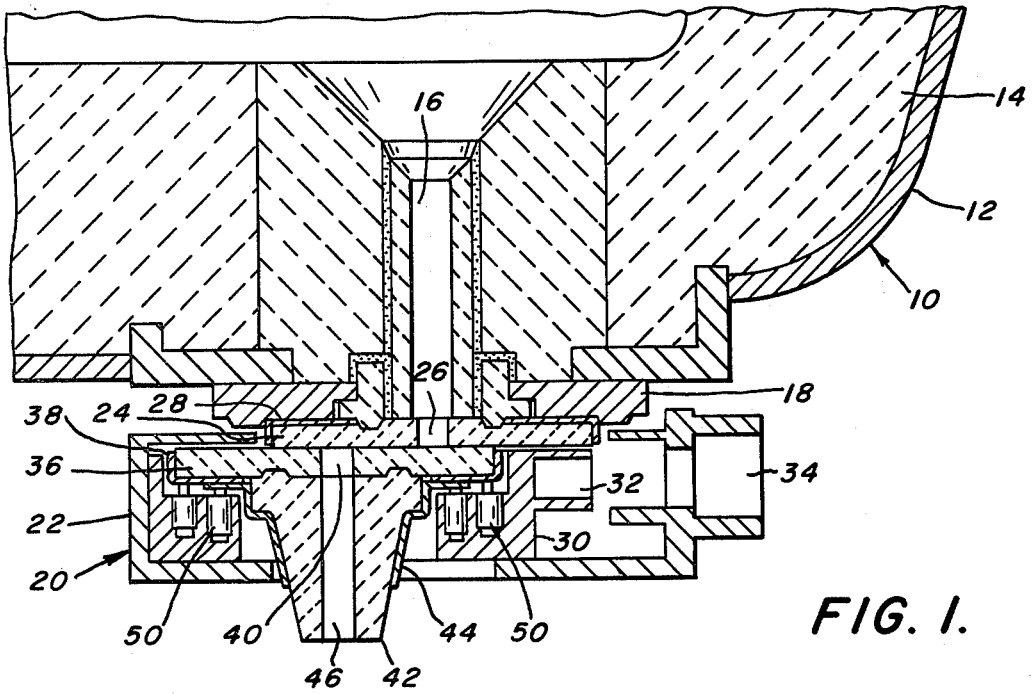
FIG. 1 is a somewhat schematic vertical sectional representation of a slide valve of the described type incorporating spring elements constructed according to the present invention.

In FIG. 1 there is shown the lower region of a metal pouring ladle 10 including a shell 12 and a refractory lining 14. A through opening 16 is provided in the bottom of the ladle extending through the lining 14 and the shell 12 to permit the passage of molten metal. A mounting plate 18 is attached to the shell 12 about the opening 16 for attachment of the slide valve, indicated generally as 20.

The slide valve 20 comprises a housing 22 that is attached to the mounting plate 18 by means, such as bolts (not shown) or other appropriate attachment means. The housing 22 mounts a fixed refractory plate 24 having an opening 26 in vertical alignment with the ladle opening 16. The fixed plate is cemented in a metal casing 28 and disposed in tight surface engagement with the lower surface of the mounting plate 18.

A slide frame 30 is mounted in the housing 22 and is adapted for laterally guided sliding movement therewithin. Power operated means, such as a fluid motor (not shown) are engageable with the slide frame 30 by means of a connecting element 32 provided thereon and by means of an opening 34 provided in the housing 22 to permit passage of the fluid motor drive element. The slide frame 30 is provided with means for mounting slide plate 36 having an upper surface disposed in facing, sliding engagement with the lower surface of the fixed plate 24. The slide plate 36 is cemented in a metal casing 38 similar to the casing 28 and contains a through opening 40 that is alignable with the opening 26 through fixed plate 24 to effect, when in registry with one another, passage of molten metal from the ladle 10 and, when not in registry, termination of such passage.

The slide frame 30 also mounts a conically formed pour bushing 42 constructed of refractory material and cemented in metal casing 44. The pour bushing 42 is positioned in engagement with the lower surface of the slide plate 26 and arranged for movement therewith. An axial opening 46 through the bushing is vertically aligned with the opening 40 to effect passage of metal from the ladle 10 therethrough.

It should be recognized that only so much of a description of the slide valve mechanism is provided as is necessary for a complete understanding of the present invention. For a more complete description of the construction and operation of a slide valve of the type described herein reference should be made to U.S. Pat. No. 3,501,068, issued Mar. 17, 1970 to J. T. Shapland and to U.S. Pat. No. 3,480,186 referred to hereinabove.

According to the present invention, there are provided spring elements of improved construction operative to urge the facing surfaces of respective of the members of the slide valve mechanism, especially the refractory members thereof, into tight abutting engagement in order to reduce the possibility of leakage at the respective member interfaces. Such spring elements are indicated generally as 50 in FIG. 1 and are shown therein as being disposed in two sets, one being adapted to urge the slide plate 36 upwardly against the fixed plate 24 and the other adapted to urge pour bushing 42 upwardly against the bottom of slide plate 36. Only one such spring element 50 and an alternative modification 50' thereof is described hereinafter.

The spring elements 50 are mounted in the body of slide frame 30 each in a cylindrical recess 52 provided therein. The respective recesses 52 each have a bottom surface 54 to seat the spring element and are each provided with a short axial extension 55 of reduced diameter defining a space to accommodate a spring element gas injection plug as hereinafter described.

Figure 2:
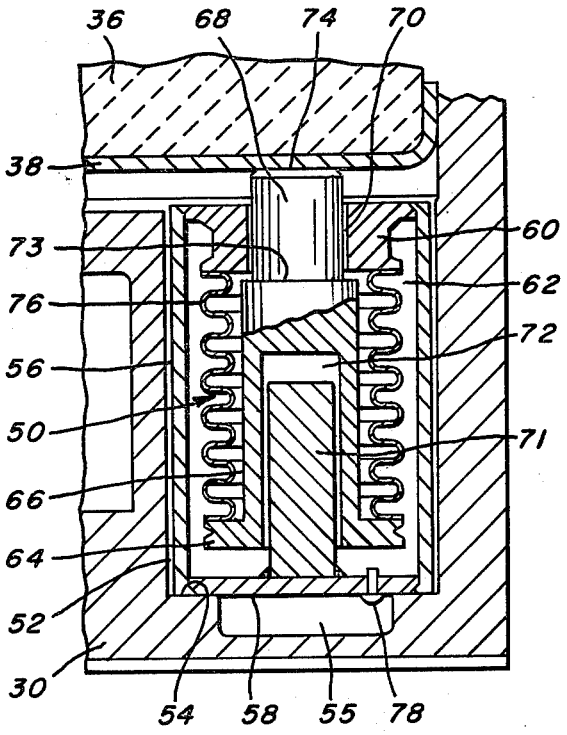
FIG. 2 is an enlarged vertical section of one of the spring elements illustrated in FIG. 1.

The spring element 50 shown in FIG. 2 comprises a rigid, hollow cylindrical body 56 defining a tubular enclosure that is closed at the bottom end by base plate 58 and at the top by end plate 60 to form a substantially closed chamber, indicated as 62. The chamber 62 contains a piston assembly comprising piston head 64 and piston rod 66 that are axially movable with respect to the body 56. The upper portion 68 of the piston rod 66 is formed of a reduced diameter and extends through an opening 70 formed in the body end plate 60, the latter being sized to guidingly pass the piston rod. Guided movement of the piston rod 66 within the chamber 62 is enhanced by the provision of a cylindrical pin 71 fixed to the base plate 58 which slidably mounts the piston rod for axial movement in a complimentary recess 72 provided therein. Axial movement of the piston assembly with respect to the body 56 is limited by the engagement of the annular shoulder 73 formed at the juncture of the reduced diameter portion 68 with the shaft of the piston rod and the body end plate 60. The top end 74 of the piston rod defines a thrust surface which, as shown in the figure is adapted to engage the adjacent casing 28 of slide plate 36. The chamber 62 is sealed by means of an annular metal bellows 76 which surrounds the piston rod 66 and whose opposite ends are sealedly welded to the piston head 64 and end plate 60 of body 56.

The space defined between the body 56 and bellows 76 and also between piston head 64 and base plate 58 is filled with operating fluid preferably in the form of a pressurized inert gas such as nitrogen or argon, that is admitted to the chamber through an opening in the base plate that is closed by plug 78.

In operation, each spring element is supplied at room temperature with operating fluid from an external source through the base plate opening. The source is removed and plug 78 inserted in the opening prior to placement of the spring elements into their respective slide frame recesses 52. When pressurized gas is applied to the chamber the piston assembly is moved to its fully extended position with the shoulder 73 engaging the end plate 60. When the valve is closed however, the thrust surface 74 engages the slide plate casing 28 and the piston assembly is physically retracted to the position shown in FIG. 2 by the downward force imparted by the engagement. Thereafter, under the influence of heat transmitted from the ladle 10, the pressure of the gas contained in the chamber 62 is increased to impart an upward force against the piston head 64. This force, is concomitantly, brought to bear against the slide plate 26 through the thrust surface 74 thereby to urge the former in tighter engagement with the fixed plate 24.

Figure 3:
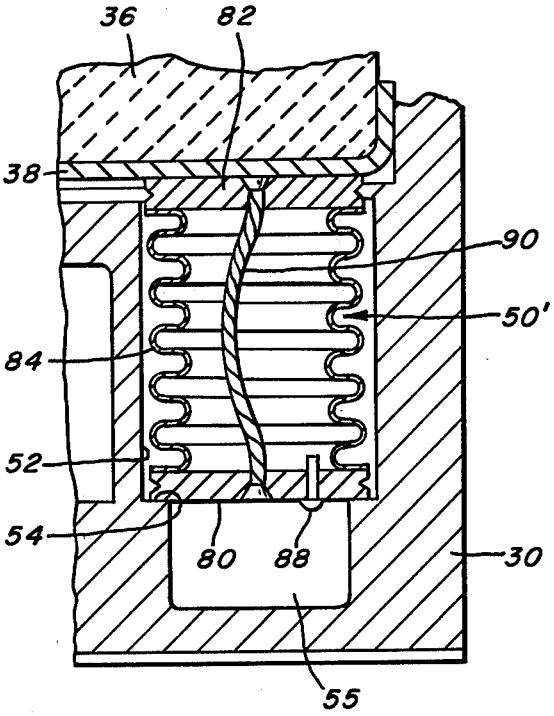
FIG. 3 is an enlarged vertical section of an alternative form of spring element.

FIG. 3 of the drawing illustrates a spring element, indicated generally as 50', of modified construction. In this embodiment of the invention the spring element 50' comprises two axially spaced plates, indicated respectively as base plate 80 and thrust plate 82, that are interconnected by an annular bellows 84 whose opposite ends are sealedly joined to the respective plates to form a totally sealed, expandable chamber 86. Operating fluid is injected into the chamber 86 through an opening in base plate 80 that is closed by plug 88. In this embodiment of the invention the axial movement of the thrust surface which is defined by the upper surface of the thrust plate 82 is limited by the length of flexible cable 90. The cable 90, as shown in FIG. 3, extends through the interior of the chamber 86 and has its opposite ends attached to the respective plates.

The characteristics and advantages of the spring elements constructed according to the invention are described by using spring element 50', shown in FIG. 3, as an example. The average piston surface of spring element 50' i.e. the surface of base plate 80 and of thrust plate 82, upon which the pressure medium acts is equal to approximately 7 square centimeters. The initial pressure at the filling opening during filling at room temperature is 29.5 atmospheres (atu) in the considered example. Accordingly, the force acting upon flexible cable 90 is 204 kilograms (kp).

When a series of spring elements 50' are mounted in the sliding frame and the latter is in closed position then the spring element is compressed by 8.5 millimeters. The volume decrease causes an adiabatic pressure increase; at constant temperature the pressure increase can be approximated by an isotherm. Due to the volume decrease the pressure increases from 29.5 atmospheres (atu) to 36.8 atmospheres (atu) and thus the thrust exerted by the spring element increases from 204 to 256 kilograms (kp). If the ladle is in operation then the spring element and its filler gas are heated and, with a temperature increase from 293° K. to 573° K., the pressure increases by an additional 72 atmospheres (atu), and the thrust increases to 500 kilograms (kp).

This clearly shows the advantages of the invention. If a desired spring force of 500 kilograms (kp) is assumed then, according to the invention, closing is performed at approximately one half of this value and the, heretofore, required expensive cooling means for the spring elements are eliminated. Also, one can see that the reduction in spring force caused by thermal stresses is avoided. Frequency of inspections of the spring elements can be considerably decreased and only exceptionally is it necessary to replace defective spring elements. The low pressures which are used and, especially, the reduced gas volume of the spring elements, combined with the fact that they are mounted in recesses, forming protective envelopes, exclude secondary effect destruction by external causes and, as a result of the small volume of these pressure containers, safety precautions, dismantling and supervision procedures are simple to implement. An additional substantial advantage results from the fact that these spring elements are compact and operate independently one from the other. They are comparable in size with conventional helical spring elements heretofore used so that existing slide valves can be provided with spring elements made according to the invention without modifications.

It wil be understood that various changes in the details, materials and arrangements of parts which have been herein described and illustrated in order to explain the nature of the invention, may be made by those skilled in the art within the principle and scope of the invention as expressed in the appended claims.

I claim:

1. A resilient biasing device particularly adapted for use in a high temperature environment to impart an oppositely outwardly longitudinal bias between two spaced-apart members comprising:

(a) a rigid, hollow body defining an enclosure, (b) the opposite ends of said body being closed by end closures, a first one of which forming a longitudinally outwardly facing bearing surface adapted to engage one of said members and a second one of which containing a through opening;

(c) a longitudinally movable piston within said enclosure having a piston head longitudinally spaced from said first end closure and a piston rod extending through the opening in said second end closure;

(d) shoulder means on said piston rod engageable with said second end closure for limiting the longitudinal movement of said piston;

(e) a resilient bellows concentrically disposed between the wall of said enclosure and said piston, said bellows having its opposite ends sealedly connected to said piston head and said second end closure about the opening therein;

(f) a bearing surface on said piston rod facing longitudinally outwardly opposite from the facing direction of said other bearing surface; and (g) a thermally expandable fluid sealedly contained in said enclosure in the space surrounding the exterior of said bellows and said piston head and operative to increase the oppositely outward bias between said bearing surfaces when subjected to an increase in temperature.

2. A resilient biasing device as recited in claim 1 in which said enclosure is formed as a hollow, right circular cylinder.

3. A resilient biasing device as recited in claim 1 in which said thermally expandable fluid is an inert gas.

4. A resilient biasing device as recited in claim 3 in which said thermally expandable fluid is nitrogen.

5. A resilient biasing device as recited in claim 1 including:

(a) a guide pin upstanding from said first end closure; and (b) a complementary recess in said piston receiving said guide pin for guiding the movement of said piston with respect to said enclosure.

6. In a sliding gate valve assembly for a molten metal pouring vessel including a stationary plate, a slide frame mounting a sliding gate plate and means in said slide frame for seating resilient devices for urging said sliding gate plate into sealed engagement with said stationary plate, the improvement in which said resilient devices each comprise:

(a) a rigid, hollow cylindrical enclosure seated in said slide frame and having end closures closing the opposite ends thereof, the first of which end closures forming a bearing surface engaging either one of said slide frame or the undersurface of said sliding gate plate and the second of which end closures having an opening therethrough;

(b) a longitudinally movable piston within said enclosure having a piston head spaced from said first end closure and a piston rod extending from said piston head through the opening in said second end closure;

(c) shoulder means on said piston rod engageable with said second end closure for limiting the longitudinal movement of said piston;

(d) an upwardly facing bearing surface on said piston rod engaging the other of said slide frame or said under surface of said sliding gate plate;

(e) a resilient bellows concentrically disposed between the wall of said enclosure and said piston rod having its opposite ends sealedly connected to said piston head and said second end enclosure about the opening therein;

(f) a thermally expandable fluid sealedly contained in said enclosure in the space surrounding the exterior of said bellows and said piston head; and (g) said piston being retracted when said bearing surfaces initially engage said slide frame and said sliding gate plate respectively and said fluid, when heated, being operative to force said piston upwardly to increase the sealing engagement between said sliding gate plate and said stationary plate.

* * * * *